United States Patent [19]

Schilbe

[11] 4,353,191

[45] Oct. 12, 1982

[54] JOINING CORNERS AND INTERSECTIONS IN A LOG BUILDING CONSTRUCTION

[76] Inventor: Laird W. Schilbe, R.R. #3,, Bayfield, Ontario, Canada, N0M 1G0

[21] Appl. No.: 122,167

[22] Filed: Feb. 19, 1980

[30] Foreign Application Priority Data

Mar. 21, 1979 [CA] Canada ..... 323943

[51] Int. Cl.[3] ..... E04B 1/10

[52] U.S. Cl. ..... 52/233; 52/285

[58] Field of Search ..... 52/233, 285, 286; 46/20

[56] References Cited

U.S. PATENT DOCUMENTS 2,326,503 8/1943 Smith .

3,189,950 6/1965 Johnson ..... 52/233

FOREIGN PATENT DOCUMENTS 422498 9/1944 Canada .

425345 1/1945 Canada .

867559 4/1971 Canada ..... 52/233

64882 12/1949 Netherlands ..... 52/286

*Primary Examiner*—Alfred C. Perham

*Attorney, Agent, or Firm*—Beveridge, DeGrandi & Kline

[57] ABSTRACT

The log-type building construction includes a pair of walls which are angularly disposed relative to one another, each wall including a plurality of logs positioned one on top of the other with the walls being in interlocking relation with one another in a vertically disposed interlocked region. The logs of one wall are in interleaved or interlaced relationship with the logs of the other wall along the interlock region. In accordance with the invention the logs of each wall have an obliquely disposed mortise therein adjacent the interlock region and locking means disposed in the mortises to secure the logs of said one wall to the logs of the other wall.

11 Claims, 4 Drawing Figures

JOINING CORNERS AND INTERSECTIONS IN A LOG BUILDING CONSTRUCTION

BACKGROUND OF THE INVENTION

This invention relates to log-type building constructions, particularly improvements in means for joining the logs together at corners and intersections in such building constructions.

The prior art has provided various means for interlocking wall members of a building construction. One such construction is shown in Canadian Pat. No. 422,498 dated Sept. 5, 1944 to Fraser. This patent discloses an interlocking construction including a plurality of wall members adapted to be placed one on top of the other. Aligned mortises are formed in the members with the mouth or entrance of each mortise being narrower than its base. Locking units are provided which are capable of overlapping at least part of each of two of more wall members. Each locking unit is provided with tenons which are shaped to fit into the mortises with such unit locking the members together when their tenons are fitted into the specially shaped mortises. When it is desired to form a corner with this construction, the ends of two walls, each formed of a plurality of wall members, are brought together at an angle to each other. As shown in the patent, the adjacent ends of the walls are cut at an oblique angle such that the wall members contact each other at the extreme outer edge of the corner construction. The preferred embodiment illustrated by Fraser employs tongues and grooves in the opposite edges of the wall members as well as in the locking units.

The Fraser construction is relatively costly to manufacture in that special tools and manufacturing processes are required to form the mortises in the wall members and the specially shaped tenons on the locking units. Shrinkage of the wood may cause the tenons to split off from the remainder of the locking units or, alternatively, for the mouth or entrance portion of the mortise to split off along the grain of the wood with the result being that the corner of the building is left substantially unsupported and liable to failure.

SUMMARY OF THE INVENTION

It is an object of the invention to provide an improved form of log-type building construction which alleviates many of the disadvantages of the prior art constructions, which is very stable when erected, and which construction does not require the use of special tools to form the interlock, and which may be constructed with minimal expenditure of labour.

The log-type building construction in accordance with the invention includes a pair of walls which are angularly disposed relative to one another, each wall including a plurality of logs positioned one on top of the other with the walls being in interlocking relation with one another in a vertically disposed interlock region. The logs of one wall are in interleaved or interlaced relationship with the logs of the other wall along the interlock region. In accordance with the invention the logs of each wall have an obliquely disposed mortise therein adjacent the interlock region and locking means disposed in the mortises to secure the logs of said one wall to the logs of the other wall.

In accordance with a preferred form of the invention, the mortises comprise slots in the logs, each slot having flat generally parallel side walls, with the locking means comprising generally planar locking sections adapted to fit snugly into the obliquely disposed mortises. By virtue of this arrangement the mortises may be formed by simple saw cuts while the locking sections may comprise simple flat pieces of board.

In a typical construction the generally planar locking sections and the mortises associated therewith all lie in a common vertical plane. In the case where the walls are at right angles to one another, the common vertical plane is preferably at about a 45° angle to each of the walls. Furthermore, in the case where the interlock region is at the outside corner of the building construction, the mortises and generally planar locking sections are located to the inside of such corner thereby to protect the same from the weather etc. Preferably, the planar locking sections are so disposed as to overlap at least part of two or more adjacent logs. This provides for an interlock between adjacent logs in the horizontal direction.

In a typical construction, in the interlock region, alternate logs of said one wall each have their ends in close abutting relating to side wall portions of respective alternate ones of the other wall while even logs of the other wall each have their ends in close abutting relation to side wall portions of respective even ones of the logs of said one wall. This form of construction, in combination with the locking arrangement described above provides for a very high degree of stability, i.e. there is much less tendency for the building construction to skew, i.e. go off square and out of plumb, particularly as compared with the structure shown in the above-noted Fraser patent.

The invention in a further aspect provides a construction kit including a plurality of logs having obliquely disposed mortises therein to be located adjacent the interlock region and locking means adapted to be disposed in the mortises to enable the logs of said one wall to be secured to the logs of said other wall in the manner described previously.

BRIEF DESCRIPTION OF THE VIEWS OF DRAWINGS

The embodiments of the invention will now be described, by way of example, with reference being had to the drawings wherein.

DETAILED DESCRIPTION

Figure 1:
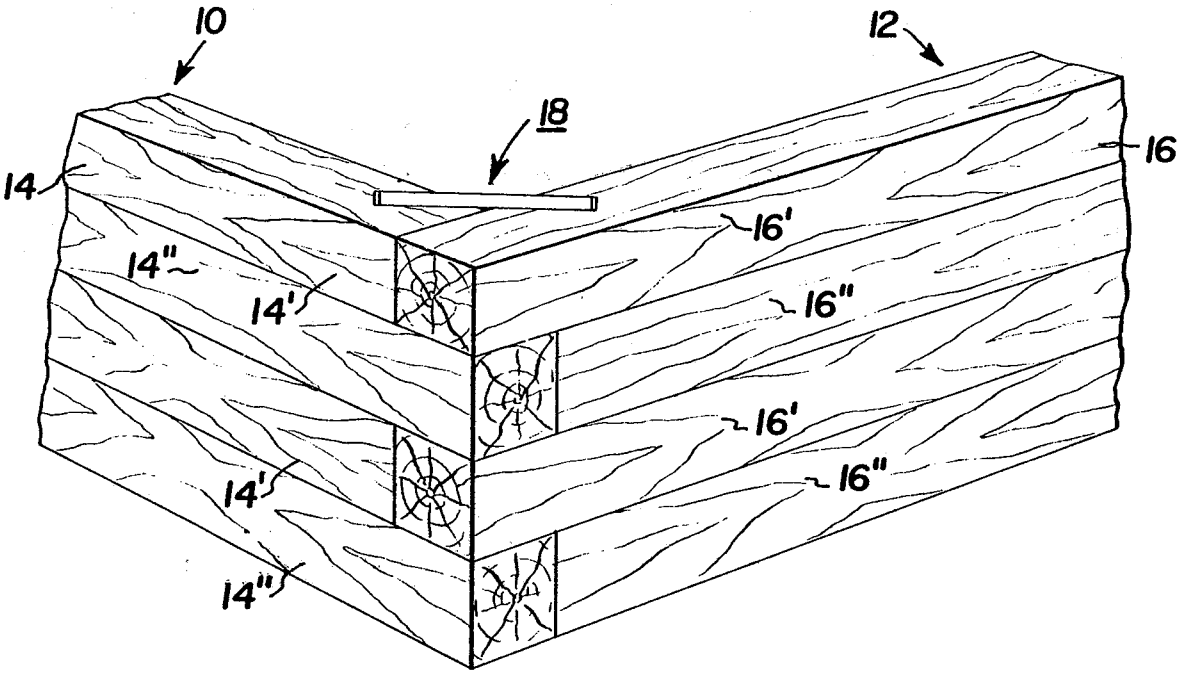
FIG. 1 is a perspective view of a building corner construction in accordance with the invention.
Figure 2:
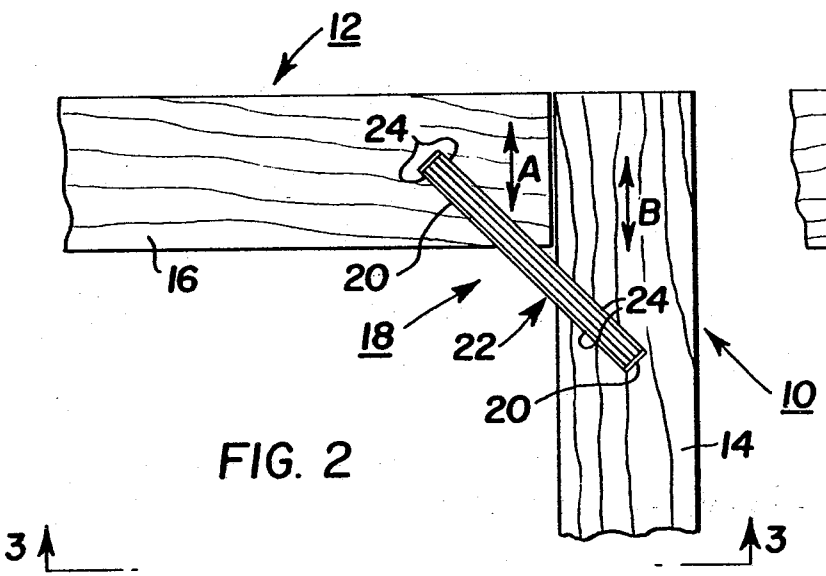
FIG. 2 is a top plan view of the corner construction shown in FIG. 1.
Figure 3:
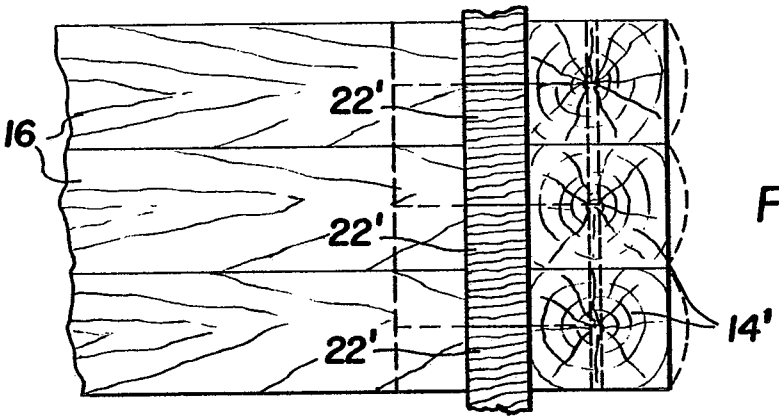
FIG. 3 is a side elevation view looking in the direction of arrows 3—3 of FIG. 2.

With reference to FIGS. 1–3 there is shown an outside corner of a log type building construction. The construction includes a pair of walls 10 and 12 which are disposed at a right angle relative to one another. Each wall 10, 12, includes a plurality of logs 14, 16 respectively, positioned one on top of the other and lying in a vertical plane. The walls 10 and 12 are disposed in interlocking relation to one another in a vertically disposed interlock region broadly designated by reference number 18. The logs 14 of wall 10 are in interleaved or interlaced relationship with the logs 16 of wall 12 along the interlock region 18. More specifically, in the interlock region, alternate logs 14' of wall 10 each have their ends in close abutting relation to side wall portions of respective alternate logs 16' of the wall 12 while even logs 16'' of wall 12 each have their ends in close abutting relation to side wall portions of respective even logs 14'' of wall 10. In the interlock region, the logs do not have the common notch or saddle construction involving transverse vertically facing notches which receive and interfit with a portion of adjacent logs.

It will be apparent to those skilled in the art that the construction shown is applicable to various log cross sections. The logs may be of square cross section, as illustrated in the drawings; alternatively, as shown in FIG. 3 in dashed lines, the outwardly exposed surfaces of the logs may be left in the natural state in order to provide a rustic appearance to the building. The principles of the invention can also be applied to full round logs so long as the inside corner surfaces of the logs are flattened thereby to provide for the close abutting relationship referred to above. Any suitable commercially available caulking compounds can be used between adjacent logs to seal the joints therebetween.

As best seen in FIGS. 2 and 3, the logs 14, 16, of walls 10, 12 respectively, each have a mortise 20 disposed obliquely relative to the longitudinal axis of the log adjacent the interlock region 18. A locking means 22 is disposed in mortises 20 to secure the logs of one wall 10 to the logs of the other wall 12. The mortises 20 comprise simple slots in each of the logs 14 and 16, each slot having flat generally parallel side walls 24. The mortises 20 in the logs of wall 10 are longitudinally aligned with and are substantially parallel to the mortises in the logs of wall 12. The locking means 22 comprise generally flat or planar locking sections 22', preferably of wood with the grain running in the horizontal direction. The locking sections 22' extend horizontally from one mortise to another, and they fit snugly in the mortises to prevent the logs from moving horizontally relative to each other.

It will be seen from FIGS. 2 and 3 that the locking sections 22' and the mortises 20 associated therewith all lie in a common vertical plane. This plane is at a 45° angle to the planes defined by the side walls 10 and 12.

As best seen in FIG. 3, the locking sections 22' are arranged so as to overlap pairs of adjacent logs. This prevents adjacent pairs of logs 14 and 16 from moving in the horizontal direction relative to the pairs of logs 14 and 16 either above or below same. Furthermore, because of the snug fit of the locking sections 22' in the associated mortises 20, logs 16 and 14 are prevented from moving in the direction of arrows A and B as shown in FIG. 2. The interleaved or interlaced corner construction described above coupled with the close abutting relation to the log ends as desscribed above also contributes greatly to the overall stability of the structure.

Figure 4:
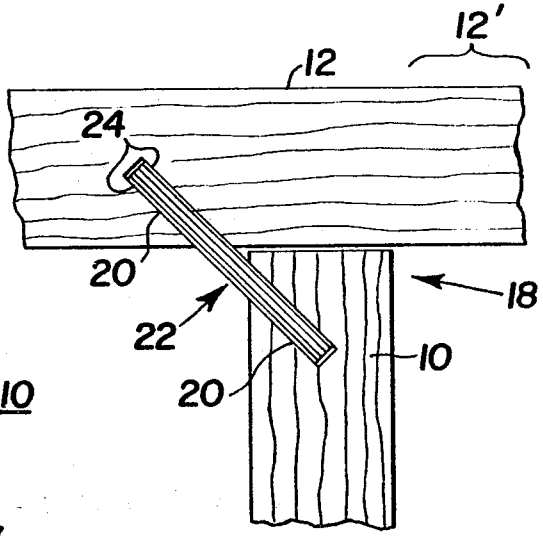
FIG. 4 is a top plan view of a wall intersection incorporating the principles of the present invention.

The wall intersection structure shown in FIG. 4 is of essentially the same structure as shown in FIGS. 1–3 except that wall portion 12' extends beyond the interlock region 18. The logs of the two walls 10 and 12 are still in the same interleaved or interlaced relationship as described previously and the locking means 22 is constructed in the same fashion as described previously and performs the same function as described above.

Since the grain of the wood for all of the building components described runs horizontally, such components will swell or shrink at substantially the same rate with any changes in humidity. Only half of the log ends are exposed to the weather and a slightly defective log end can be utilized by placing it so that the defect is on the concealed end. The mortises 20 are inside the structure away from the weather as are the locking sections 22'. If there is any failure of the exterior log joint, e.g. the caulking therebetween, the locking sections 22' and the associated mortises 20 will stop the weather. A space may be left behind the locking sections 22' thereby to conceal the services such as plumbing and wiring.

The above-described construction may be readily assembled by unskilled labour without the use of any special tools with no securing means such as nails, screws or the like being required although, of course, nails and screws will be required when fitting special constructions, such as doors and windows. The construction can also be readily dismantled by removing the locking sections 22'. The mortises 20 may be cut in the logs at the job site and the locking sections 22' may be also cut at the job site. However, it is contemplated that the various components will be made utilizing mass production techniques. The logs 14, 16 can be made in standard lengths, depending upon the overall style and plan of the building and the mortises 20 cut therein at the factory. The locking sections 22' may also be cut in standard lengths at the factory. By utilizing standard precut components the amount of time required at the job site can be very substantially reduced.

By way of general comment it should also be noted that alternate ends of the logs 14 and 16 may extend beyond the mean outer surfaces of the walls 16 and 14 at the corner to provide for more pleasing rustic appearance. It should also be noted that when the logs dry out they will shrink somewhat and the gathering will be toward the locking sections 22' which lock them together; thus there will be no separation at the regions where the ends of the logs will come into abutting relation to sidewall portions of the logs associated therewith. In addition any tendency on the part of the logs to split as a result of the forces thereon from the locking sections 22' disposed in the mortises will be in a direction away from the end; this tendency will be countered by the usual knots that occur in logs. Locking sections 22, when positioned in the mortises, will actually exert pressure on that portion of the log between the mortise and the log end most closely adjacent thereto which will resist splitting.

A preferred embodiment of the invention has been described by way of example. Those skilled in the art will realize that various modifications may be made without departing from the spirit of the invention or the scope of the claims as hereinafter set forth.

I claim:

1. A log-type building construction including a pair of walls which are angularly disposed relative to one another, each wall comprising a plurality of logs positioned one on top of the other, the walls being in interlocking relation to one another in a vertically disposed interlock region with the logs of one wall being in interleaved or interlaced relationship with the logs of the other wall along the interlock region, the logs or each wall having a mortise therein adjacent the interlock region, said mortises being disposed obliquely relative to the longitudinal axes of their respective logs, the mortises in the logs of said one wall being substantially parallel to the mortises in the logs of said other wall, locking means disposed in said mortises to secure the logs of said one wall to the logs of said other wall, said mortises comprising slots in said logs, each slot having flat generally parallel side walls, the slots in each wall being horizontally aligned with the slots in the other wall, said locking means comprising generally planar locking sections extending horizontally from within a said slot in one wall into a said slot in the other wall and fitting snugly in said slots to prevent the logs from moving horizontally relative to each other, said planar locking sections in association with the flat side walls in the mortises reducing any tendency of the building to go askew.

2. The construction of claim 1 wherein, in the interlock region, the logs are devoid of transverse vertically-facing notches which receive and interfit with a portion of an adjacent log.

3. The construction of claim 1 wherein said generally planar locking sections and the mortises associated therewith all lie in a common vertical plane.

4. The construction of claim 3 wherein said walls are at right angles to one another and said common vertical plane is at about a 45 degree angle to each of said walls.

5. The construction of claim 3 or 4 wherein said interlock region is at the outside corner of the building construction and said mortises and the generally planar locking sections are located to the inside of such corner.

6. The construction of claim 3 or 4 wherein the planar locking sections are so disposed as to overlap at least a part of two or more adjacent logs.

7. The construction of claim 1 or 3 wherein the locking means comprise a plurality of sections, each of which is disposed as to overlap at least a part of two or more adjacent logs.

8. The construction of claim 1 or 3 wherein, in the interlock region, alternate logs of said one wall each have their ends in close abutting relation to sidewall portions of respective alternate ones of the logs of the other wall, and even logs of the other wall each have their ends in close abutting relation to sidewall portions of respective even ones of the logs of said one wall.

9. For use in the manufacture of a log-type building construction of the type including at least a pair of walls which are angularly disposed relative to one another with each wall comprising a plurality of logs positioned one on top of the other and the walls being in interlocking relation to one another in a vertically disposed interlock region with the logs of one wall being in interleaved or interlaced relationship with the logs of the other wall along the interlock region, a construction kit including a plurality of logs for forming each wall, each log having a mortise therein at a location where it will lie adjacent to and interiorly of the interlock region, said mortises in said plurality of logs being disposed obliquely at equal angles relative to the longitudinal axes of their respective logs; said mortises comprising slots in said logs, each slot having flat generally parallel side walls, and locking means which are insertable into said mortises to secure the logs of said one wall to the logs of said other wall, said locking means comprising generally planar locking sections which are dimensioned to fit snugly into the obliquely disposed mortises to prevent the logs from moving horizontally relative to each other.

10. The construction of claim 9 wherein, in the interlock region, the logs are devoid of transverse vertically-facing notches which receive and interfit with a portion of an adjacent log.

11. The construction kit of claim 9 wherein said mortises are located on the logs such that they all lie in a common vertical plane when the logs are assembled together to form said walls.

* * * * *